United States Patent [19]

Ryan

[11] 3,981,500

[45] Sept. 21, 1976

[54] ADJUSTABLE SUPPORT APPARATUS

[76] Inventor: Vernon L. Ryan, 6802 Millikin Ave., Austin, Tex. 78723

[22] Filed: Oct. 17, 1974

[21] Appl. No.: 515,618

[52] U.S. Cl. ..... 272/85; 272/1 R; 272/109; 272/136; 248/204; 248/274; 24/130

[51] Int. Cl.[2] ..... A63G 9/00

[58] Field of Search ..... 248/204, 274, 125, 295, 248/297, 318, 322, 327, 328, 329, 330, 332; 297/273, 274; 24/129 B, 115 D, 130; 272/61, 85

[56] References Cited

UNITED STATES PATENTS

| | | | |
|---|---|---|---|
| 55,849 | 6/1866 | Gilson | 272/85 |
| 459,670 | 9/1891 | Barnhart | 297/273 |
| 3,077,613 | 2/1963 | Mayer | 272/61 X |
| 3,186,711 | 6/1965 | Morrow | 272/85 |
| 3,233,894 | 2/1966 | Binan | 272/61 |
| 3,246,893 | 4/1966 | Boggild et al. | 272/61 |
| 3,574,900 | 4/1971 | Emery | 24/130 |
| 3,730,471 | 5/1973 | Edwards | 248/274 |

*Primary Examiner*—William H. Schultz
*Attorney, Agent, or Firm*—Lowe, King, Price & Markva

[57] ABSTRACT

A flexible support rod is formed with a longitudinal channel for receiving a support rope. The channel extends from the upper end of the support rod downwardly along the longitudinal axis thereof and out the side of the rod. A locking cleat that releasibly secures one end of the rope is connected to the rod adjacent the egress. The support rod and rope may function as an amusement device providing the whip-like swinging action to a seat attached to the lower free end of the rope. Anyone can easily adjust the length of the rope by: (1) releasing the rope from the locking cleat; (2) extending the rope to the desired length; and then (3) re-engaging the rope in the cleat. When a hook is connected to the end of the rope, the support rod and rope may function, among other things, as a boat mooring device and the elasticity of the rod provides gentle pulling forces against any movement of the boat due to water surface currents and waves. Other embodiments may include a therapy device for bedridden patients.

15 Claims, 5 Drawing Figures

ADJUSTABLE SUPPORT APPARATUS

FIELD OF THE INVENTION

The present invention relates generally to supports, and more particularly to a flexible support rod having an adjustable length line.

BACKGROUND OF THE INVENTION

Support structures for suspending a seat for playground swinging have been commonly engineered in the past with little or no imagination to allow a youngster to improvise and change the action of the swing for greater enjoyment. For example, the well-known gym swing comprises a seat suspended by two ropes or chains from a stationary, rigid support and allows only simple back and forth motion. One change that can be made on any swing is simply to adjust the length of rope or chain, which alters the periodicity of the pendulum action. By shortening the rope, the child swings faster over a smaller arc and by lengthening the rope, he experiences a longer, but slower swing. Thus, it is desirable to provide convenient means for a child to adjust the support line in a swinging apparatus to permit him to control the swinging characteristics. Heretofore, rope or chain length has been fixed or has been inconvenient for the child to adjust. Furthermore, these prior devices, being typically rigid, provide little, if any, bouncing action to the seat. With both line control and a support allowing resilient action as I contemplate, a child can improvise new actions and games, greatly enhancing the enjoyment, as well as the educational value of the device.

In providing a support rod for boat mooring or the like, it is desirable that the support rod be somewhat flexible in order to "give" as the boat rides vertically on waves and transversely with surface currents.

In one type of prior art arrangement, Benzel U.S. Pat. No. 3,183,877, a rope is supported by a rod with one end of the rope having a hook for attachment to an eye on the boat and the other end tied down to a fixture on the dock. The rope must be taut enough to prevent excessive transverse movement of the boat in the water to avoid striking the dock, yet flexible enough to allow nominal boat movement. The rope length is adjustable in order to accommodate boats of different sizes and varying tides. These mooring devices of the prior art of which I am aware require the rope to be untied from the fixture on the dock each time an adjustment is made. This adjustment is time consuming and inconvenient. Furthermore, the rope dangling from the rod has a tendency to become entangled with other lines and is unsightly.

OBJECTIVES OF THE INVENTION

Accordingly, it is one object of the present invention to provide a new and improved support rod that is flexible and suspends a rope having an easily adjustable length.

It is yet another object of the present invention to provide playground apparatus providing a whip-like swinging action that is easily adjusted, even by a child.

It is another object of the present invention to provide a new and improved flexible mooring apparatus or the like that yields to nominal movement and utilizes a line that is adjustable without being untied.

BRIEF DESCRIPTION OF THE PREFERRED EMBODIMENT

The support rod of the present invention comprises an arcuate, flexible rod that is formed with an internal channel to receive a support rope. The channel extends from the upper end of the rod downwardly along the longitudinal axis thereof and through an egress to the outer surface of the rod near the lower end thereof. A locking cleat is attached to the rod adjacent the egress for releasibly securing the rope. The rope is adjustable by simply manually pulling the rope along the channel to the desired length and then seating the rope in the locking cleat.

For application as playground apparatus, the rope supports a seat, the rod supports the rope and the lower end of the rod is mounted in the ground. As a mooring device, the rod is mounted to a dock and the rope supports a boat hook. Other devices can be secured to the free end of the rope for other applications, both utilitarian and decorative.

The support rod may be mounted on a wheeled platform for transportability, for example, to function as a convenient exercise device for bed-ridden patients.

Still other objects and advantages of the present invention will become readily apparent to those skilled in this art from the following detailed description, wherein I have shown and described only the preferred embodiments of the invention, simply by way of illustration of the best modes contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE PREFERRED EMBODIMENT

Figure 1:
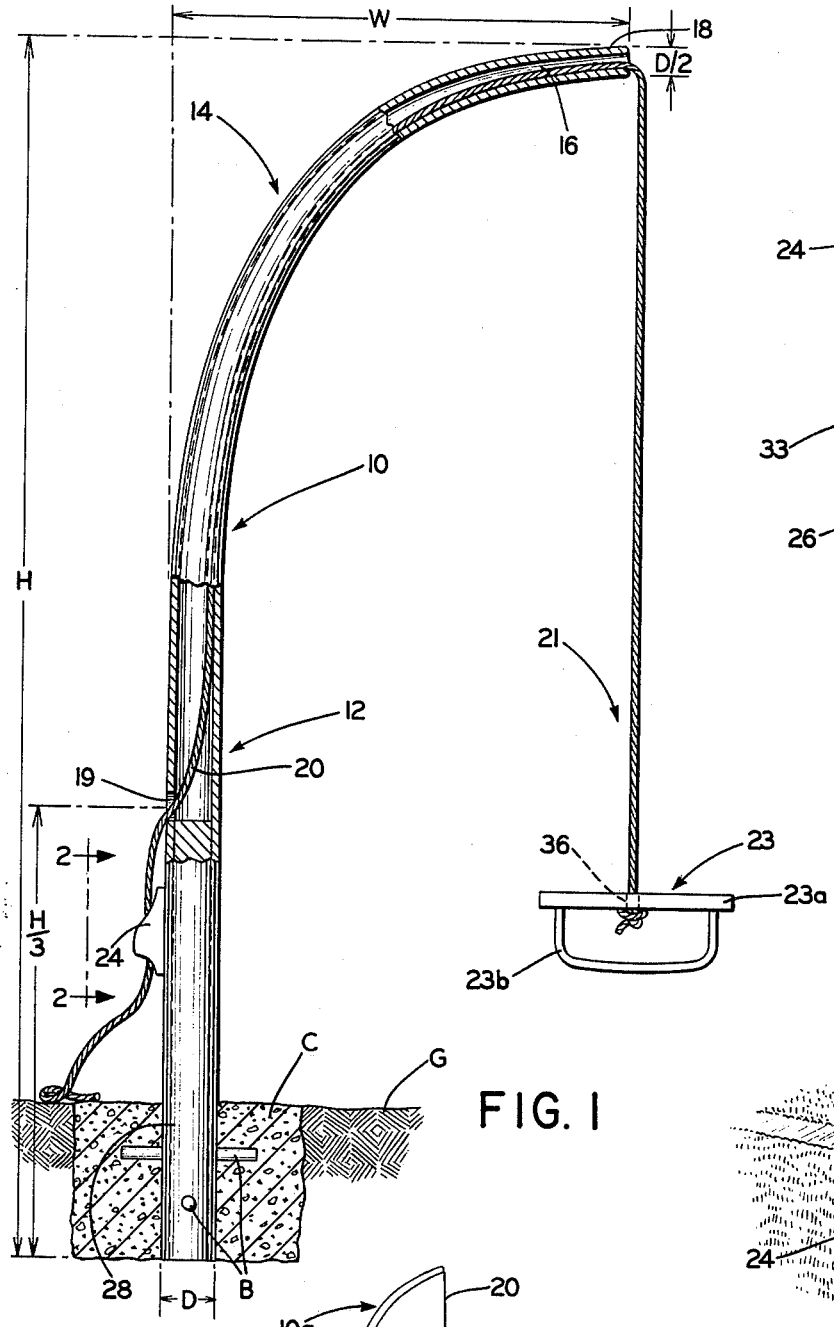
FIG. 1 is a partial sectional view of the support rod of the present invention including a swing attached to the end of the support rod.

Referring to FIG. 1, support rod 10 is arcuate having a vertical, substantially straight lower portion 12, and a curved upper portion 14 that becomes substantially horizontal at upper end 18. The preferred geometry of the upper portion 14 is a quadrant of a circle, as shown; although other geometric shapes, such as a quadrant of an ellipse, may be utilized in accordance with the broader aspects of the invention.

Support rod 10 is formed with height H and a width or horizontal extent W. Width W of support rod 10 is large enough to provide suitable flexibility for the purposes set out and, at the same time, to prevent interference between the lower portion 12 and the article suspended. In practice, I have found that a width-to-height ratio of approximately one-half forms a satisfactory support structure. These measurements are taken in the vertical and horizontal planes shown in FIG. 1.

To provide a secure base for the rod 10 for outdoor use, a concrete slab C is provided in ground G. Cross reinforcing bars B may be provided as shown to assure against the lower end eventually working loose.

Support rod 10 has a base diameter D at lower end 28 and is formed with a continuous upward taper. At the upper end 18, the diameter is preferably reduced to approximately D/2. The strength of the support rod is enhanced by providing solid mass at the base portion while the upward taper enhances the flexibility of the rod.

Internal channel 16 formed in support rod 10 extends from upper end 18 longitudinally through upper portion 14, down through lower portion 12, and out the side of the rod. Egress or opening 19 is located at a height of approximately one third the height H of the rod, or H/3.

Rope 20 extends through the channel and is suspended from upper end 18 of rod 10, hanging freely therefrom. Articles to be supported are attached to free end 21 of rope 20 by any suitable means, such as tying.

A locking cleat 24 is mounted to rod 10 adjacent egress 19 to engage and anchor the opposite end of the rope 20. Locking cleat 24 is preferably mounted just under egress 19 with a pair of screws 26 (shown in FIG. 2).

In order to maximize the strength of support rod 10, the channel 16 does not extend beyond egress 19, i.e., support rod 10 is of solid construction from egress 19 to the lower end 28 of the rod. This distance is H/3, or 1/3 the vertical height of the rod.

Support rod 10 is preferably formed of reinforced fiberglass, such as a 50% glass, 50% resin composition. I have found that the support rod 10 of the configuration and material described results in a unit that is flexible, yet strong and durable. Because rope 20 is contained within the channel 16, no unsightly dangling of the rope exists, the rope is advantageously smoothly guided between the upper and lower ends 18, 28 without the need of guide eyelets or the like, and the lower end of the rope is conveniently engageable in the locking cleat 24 adjacent the egress 19.

Figure 2:
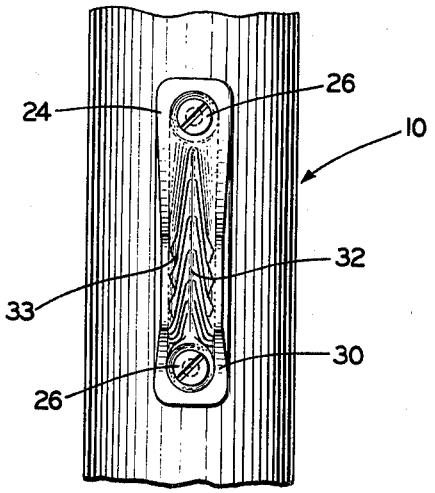
FIG. 2 is a partial side view of the apparatus of FIG. 1 illustrating the locking cleat.

Referring to FIG. 2, locking cleat 24 is preferably formed of plastic and includes a base 30 and a rope engaging open throat or channel 32. Throat 32 contains a plurality of inwardly and upwardly extending ridges 33 on the side walls. The ridges 33 grip rope 20 when the rope is seated by being pushed into the throat and pulled upwardly. As operating tension is applied to the rope 20, the reaction forces on the rope generated by the angled ridges, press the rope further down into the throat 32, against the back wall. This action locks the rope 20 in position at the desired extended length. Rope 20 is released from cleat 12 by flipping the rope outwardly from channel 32 with a slight downward action, thereby providing a quick release.

The gripping action of the cleat 12 against rope 20 is a simple, yet extremely secure means of locking the rope in position on support rod 10. It is failsafe under normal loads because as the rope 20 is pulled upwardly within throat 32 as the rope is loaded, the rope seats even more firmly against the back wall of said throat.

Figure 3:
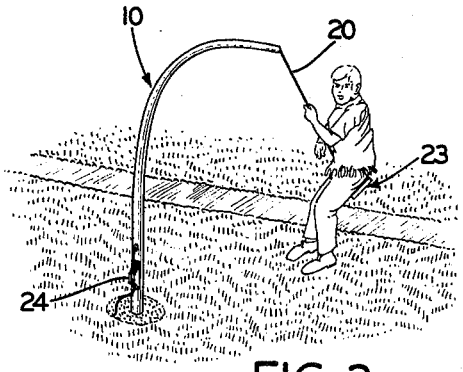
FIG. 3 is an illustration of the support rod of FIG. 1 in use as playground apparatus.

Support rod 10 makes an ideal playground apparatus by mounting a seat 23 to the end of the freely hanging portion 21 of rope 20. When seat 23 is operatively loaded by a child as shown in FIG. 3, rope 20 is seated firmly in channel 32, as described above. The rope does not slide or give way under the weight of the child. Support rod 10 flexes as the child applies his weight to seat 23 and it imparts a whip-like action to the free portion of the rope and seat as the child jumps and moves from side to side. Thus, the child can simultaneously bounce and swing, as the entire rod 10 bends and flexes adding a new and exciting dimension to playground activity.

As the child holds on to the rope 20, the arm and upper body muscles are flexed providing healthful exercise. The child is encouraged to move and shift the rope through the hands to add further variations of bouncing and swinging movement to the ride. This extension of muscle effort is highly advantageous to building better muscle tone.

The child easily adjusts the length of the freely hanging portion 21 of rope 20 by decoupling the rope from locking cleat 24, sliding the rope in or out the opening 19 and then seating the rope back in the locking cleat 24. This enables the child to change the periodicity of swinging action, and thereby provide an almost infinite variety of movements and sensations.

While affording a safe means by which the child is entertained and develops his growing muscular needs, the apparatus also functions as an educational device whereby the child correlates the length of a swinging pendulum to the several related parameters thereof. The child soon learns that by adjusting the rope to a longer length, he bounces and swings more slowly and with greater amplitudes (longer arcs); whereas, a shorter length causes him to swing and bounce more quickly and with less amplitude. Further, the child also learns that a heavier person, or two persons riding buddy style, cause greater bending action on the support rod causing the seat to come closer to the ground, illustrating to the child the principles of a weighing scale. Also, with the heavier weight, the child learns that greater amplitude of movement from bouncing action and greater swinging movement from side to side is possible.

The seat 23 comprises a substantially planar board **23*a* having an aperture 36 for receiving the end of the rope 20. The end of said rope 20 is inserted through aperture 36** and then a knot may be simply formed therein for supporting the seat.

Seat 23 also includes a grip and reinforcing bar **23*b*, formed under the board 23*a*. Grip bar 23*b* functions as a hand grip or foot grip permitting seat 23 to support children in two different ways, or support two children at a time. For example, one child may sit or stand on the board 23*a*, while another child stands on the grip 23*b*. If desired, a child can raise seat 23 to the extent of his height by operating locking cleat 24 and then can swing from seat 23 by holding grip bar 23*b*** like a trapeze. A child can also lower the swing to a position just over the ground for use as a swinging platform.

Figure 4:
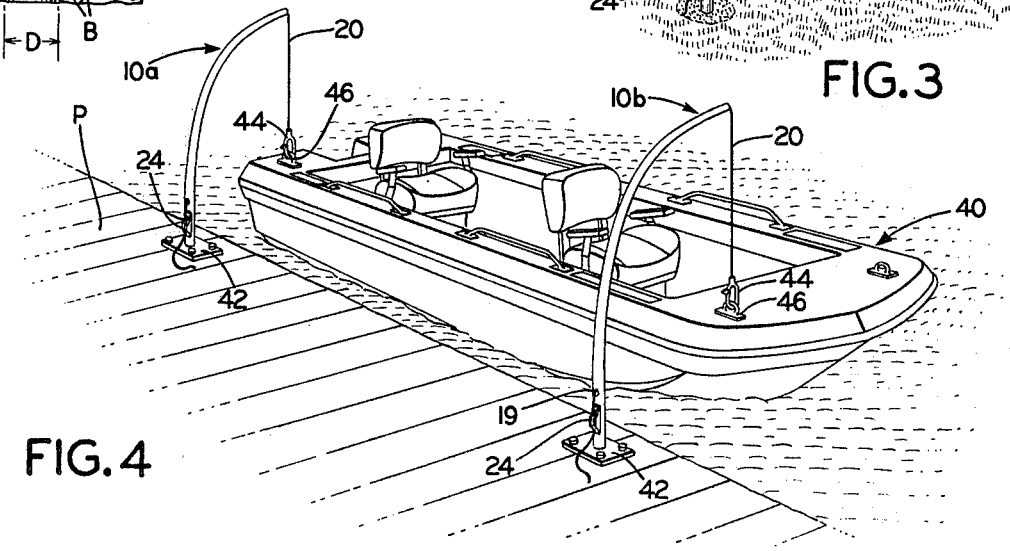
FIG. 4 is an illustration of a pair of support rods of the present invention functioning as boat mooring apparatus.

Referring to FIG. 4, a pair of support rods **10*a* and 10*b*, according to the present invention, is applied as mooring apparatus for boat 40. Support rods 10*a* and 10*b* are anchored to dock P by means of anchor bolts 42. Each rod 10*a* and 10*b* suspends a rope 20 and a hook 44 is connected to the freely hanging end of each rope. A locking cleat 24** is provided for each rod to anchor the opposite end of each rope.

In operation, hooks 44 are secured to eyes 46 on the boat 40 and rope 20 is pulled to length. When the rope is taut, and the support rod just begins to flex, the rope is set into locking cleat 24. As the boat rides the waves, the motion is taken up by the flexing of support rods 10*a* and 10*b* with ropes 20 remaining taut. The hanging length of each rope 20 can be increased or decreased by releasing the rope from locking cleat 24, letting out or taking in the desired additional length of rope and the re-seating of the rope into the locking cleat. This operation is extremely fast and simple and does not require tying and untying of lines.

It is to be understood that support rod 10 can be applied in other diverse applications. For example, in FIG. 5, support rod 10 is supported by wheeled base assembly 50 for transportability. Support rod 10 may be removable from base assembly 50 for convenient storage by lifting the support rod from its socket in the base assembly.

Figure 5:
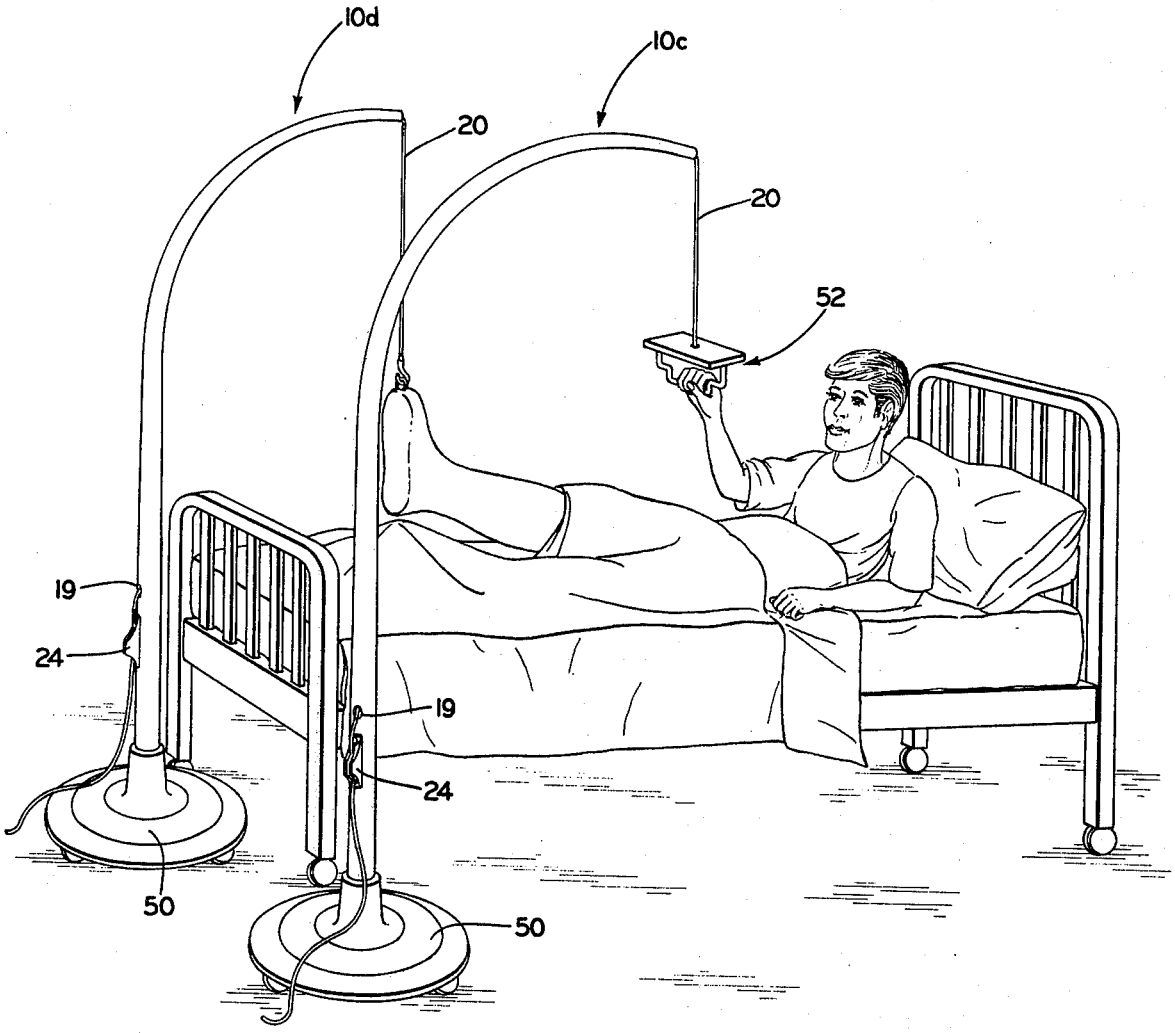
FIG. 5 is an illustration of the support rod mounted on a wheeled platform to function as a support for hospital patients.

The support rod 10 of the present invention is especially suitable for application to post-operative hospital care due to the aforementioned convenient adjustability of the length of rope 20. In FIG. 5, a patient is gripping a hand-grip unit 52 of support rod 10*c*. Grip unit 52 may be identical to seat 23 with grip bar 23*b*, as shown in FIG. 1.

Another support rod 10*d* is supporting a leg of the patient in a cast. The flexing of the rod absorbs stresses imparted to the leg as the patient shifts his weight on the bed, and affords a maximum degree of freedom to the leg while providing a sturdy support.

In this disclosure, there is shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. In combination:

an arcuate, flexible support rod, a channel being formed along the longitudinal axis of an upper portion of said rod;

a rope slidingly mounted in said channel, one end of said rope extending from an upper end of said rod, the upper end being substantially horizontal;

an opening in the upper portion of said rod adjacent a lower portion of said rod to allow the other end of said rope to extend from said rod;

a seat means connected to said one end of said rope; and a quick-release locking means connected to said support rod for releasably securing said other end of said rope, the length of said rope extending from the upper end of said rod depending on the portion of said other end of said rope secured to said locking means.

2. The apparatus of claim 1 wherein said support rod is tapered, the diameter of the rod at the upper end thereof being approximately one-half the diameter of the rod at the lower end thereof.

3. The combination of claim 1 including wheeled base means for mounting the other end of said support rod.

4. The combination of claim 1 wherein said quick-release locking means includes a cleat having side walls and a rear wall forming an open channel, upwardly and inwardly extending ridges on said side walls to urge said rope against the rear wall when tension is applied.

5. The combination of claim 1 wherein said opening is located at approximately one third the vertical height of said rod.

6. The combination of claim 5 wherein the horizontal width of said rod is approximately one-half the vertical height of said rod.

7. The combination of claim 1 wherein said seat means includes a substantially planar board having an aperture for receiving said one end of said rope.

8. The combination of claim 1, including a gripping means attached to said seat means, a portion of said gripping means being spaced apart from said seat means.

9. The combination of claim 8, wherein said gripping means is attached to said seat means on opposite sides of said rope.

10. The combination of claim 8, wherein said gripping means is located beneath said seat means.

11. The combination of claim 8, wherein said gripping means includes a U-shaped member.

12. The combination of claim 8, wherein said gripping means includes an integral U-shaped member attached to an underside of said seat means on opposite sides of said rope.

13. The combination of claim 1, wherein said lower portion of said rod is of solid construction.

14. The combination of claim 1, including means for vertically mounting said rod in the ground.

15. The combination of claim 1, wherein said rod is formed of reinforced fiberglass.

* * * * *